US009016033B2

(12) United States Patent
Ciou

(10) Patent No.: US 9,016,033 B2
(45) Date of Patent: Apr. 28, 2015

(54) FILM CLAMPING AND CUTTING DEVICE OF FILM WRAPPING MACHINE

(75) Inventor: Sheng-Tian Ciou, Chia Yi Hsien (TW)

(73) Assignee: Tien Heng Machinery Co., Ltd., Chia Yi Hsien (TW)

( * ) Notice: Subject to any disclaimer, the term of this patent is extended or adjusted under 35 U.S.C. 154(b) by 1245 days.

(21) Appl. No.: 12/896,197

(22) Filed: Oct. 1, 2010

(65) Prior Publication Data

US 2012/0079929 A1 Apr. 5, 2012

(51) Int. Cl.

| | |
|---|---|
| ***B65B 11/04*** | (2006.01) |
| ***B65B 61/06*** | (2006.01) |
| ***B26D 5/20*** | (2006.01) |
| ***B26D 5/16*** | (2006.01) |
| ***B26D 7/02*** | (2006.01) |
| *B26D 1/30* | (2006.01) |

(52) U.S. Cl.

CPC . *B26D 5/20* (2013.01); *B26D 1/305* (2013.01); *B26D 5/16* (2013.01); *B26D 7/02* (2013.01)

(58) Field of Classification Search

CPC ..... B65B 11/00; B65B 67/08; B65B 11/045; B65B 11/02; B65B 11/008; B65B 9/135; B65B 11/025; B65B 11/48; B65B 11/50; B65B 61/005; B65B 61/06; B65B 27/00; B65B 2210/14; B26D 5/20

USPC ..... 53/399, 441, 556, 587, 588, 211, 210, 53/389.3; 225/35, 82, 101, 102

See application file for complete search history.

(56) References Cited

U.S. PATENT DOCUMENTS

| | | | | |
|---|---|---|---|---|
| 6,164,047 | A * | 12/2000 | Rossi | 53/587 |
| 6,185,900 | B1 * | 2/2001 | Martin et al. | 53/211 |
| 6,189,291 | B1 * | 2/2001 | Martin et al. | 53/399 |
| 6,269,610 | B1 * | 8/2001 | Lancaster et al. | 53/399 |
| 6,449,922 | B2 * | 9/2002 | Lancaster et al. | 53/399 |
| 6,761,017 | B1 * | 7/2004 | Rossi et al. | 53/587 |
| 6,848,237 | B2 * | 2/2005 | Lancaster et al. | 53/399 |
| 7,089,713 | B2 * | 8/2006 | Lancaster et al. | 53/399 |
| 2012/0102881 | A1 * | 5/2012 | Moore et al. | 53/399 |
| 2012/0240516 | A1 * | 9/2012 | Chapon et al. | 53/203 |
| 2013/0312366 | A1 * | 11/2013 | Ciou | 53/203 |

* cited by examiner

*Primary Examiner* — Thanh Truong
*Assistant Examiner* — Praachi M Pathak
(74) *Attorney, Agent, or Firm* — Rosenberg, Klein & Lee

(57) ABSTRACT

A film clamping and cutting device of a film wrapping machine is revealed. A connecting plate of a film clamping and cutting unit is located by a braking part. Moreover, by moment of a rotating machinery before stopping, a film clamping and cutting unit main body assembled on the rotating machinery is driven to continue moving. Under the movement of the unit main body, a pulling force is generated by a pull cord arranged between the connecting plate and a vertical-wheel of the unit main body. The pulling force rotates the vertical-wheel so that both a film clamping and cutting rod assembled with the vertical-wheel and a clamp fall toward a blade block to clamp and cut off a film. The film is also pulled and cut by an elastic recovery force of the film clamping and cutting rod. Therefore automatic film clamping and cutting is carried out.

10 Claims, 10 Drawing Sheets

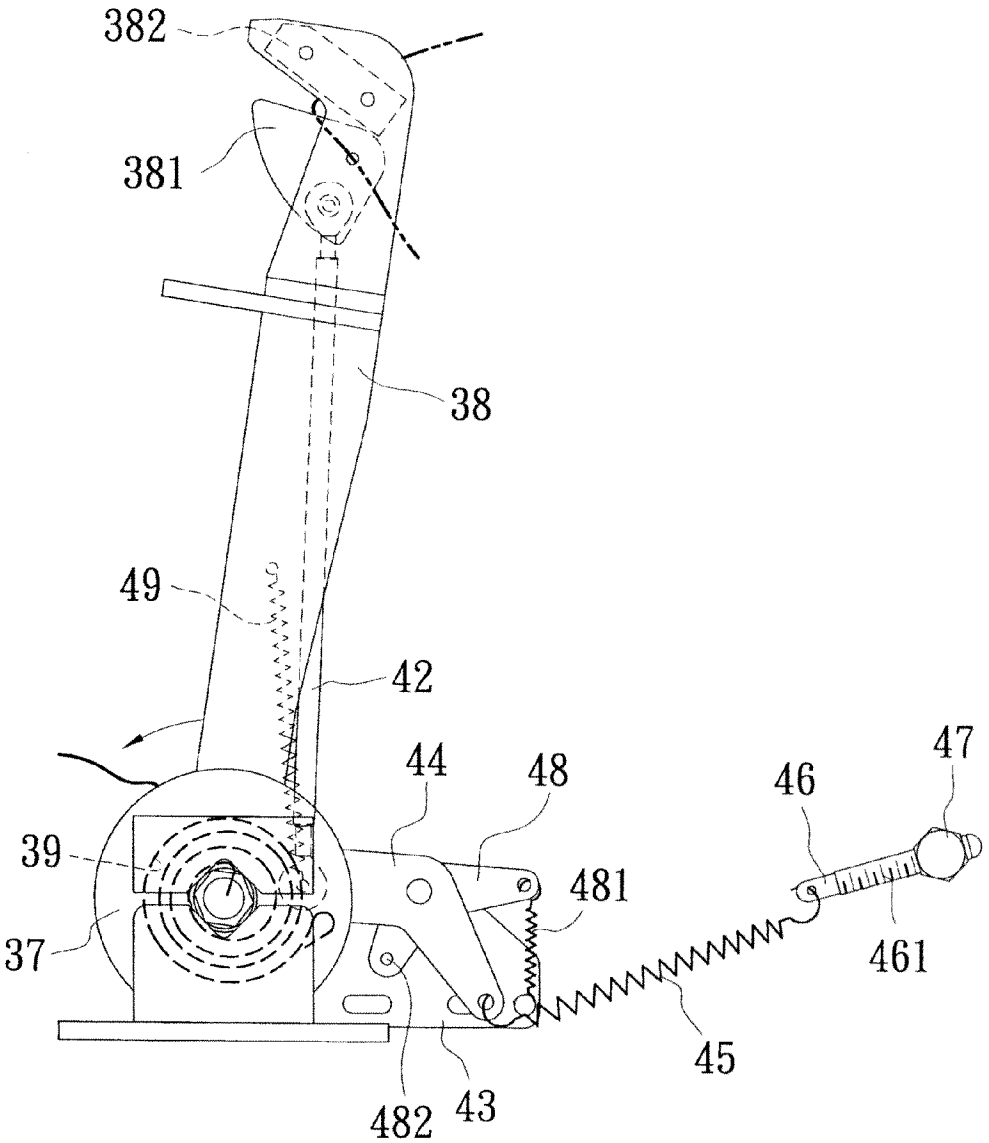
FIG. 6
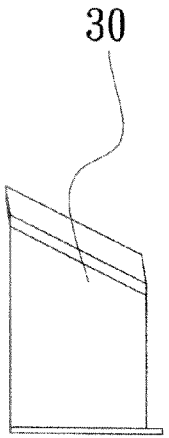

FILM CLAMPING AND CUTTING DEVICE OF FILM WRAPPING MACHINE

BACKGROUND OF THE INVENTION

1. Field of the Invention

The present invention relates to a film clamping and cutting device of film wrapping machines, especially to a film clamping and cutting device that clamps, cuts film and applies the film to the next pallet automatically so as to save manpower.

2. Description of Related Art

Generally, large cargoes packed in cartons or containers are wrapped with film again for resistance to water and stain. In early days, the film is wrapped around the cargoes by use of manpower. This is not only with low efficiency but also with high labor cost.

The film cutting and film applying to the next product to be packaged by human consume too much labor force. Thus there is a need to have an automatic film cutting device for saving labors and time. Moreover, the operation will be smoother.

SUMMARY OF THE INVENTION

Therefore it is a primary object of the present invention to provide a film clamping and cutting device of film wrapping machines in which the film is clamped, cut and applied to products on the next pallet automatically.

In order to achieve above object, a film clamping and cutting device of film wrapping machines according to the present invention uses a braking part to locate a connecting plate disposed on a film clamping and cutting unit. By moment of a rotating machinery before stopping, a film clamping and cutting unit main body assembled on the rotating machinery is driven to continue moving. Under the movement of the unit main body, a pulling force is generated by the pull cord arranged between the connecting plate and a vertical-wheel of the unit main body so that the vertical-wheel is pulled and rotated. Thus both a film clamping and cutting rod assembled with the vertical-wheel and a clamp fall toward a blade block to clamp and cut off a film. Therefore, automatic film clamping and cutting is achieved.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein

FIG. 6 is a front view of a film clamping and cutting unit according to the present invention;

DETAILED DESCRIPTION OF THE PREFERRED EMBODIMENT

Figure 1:
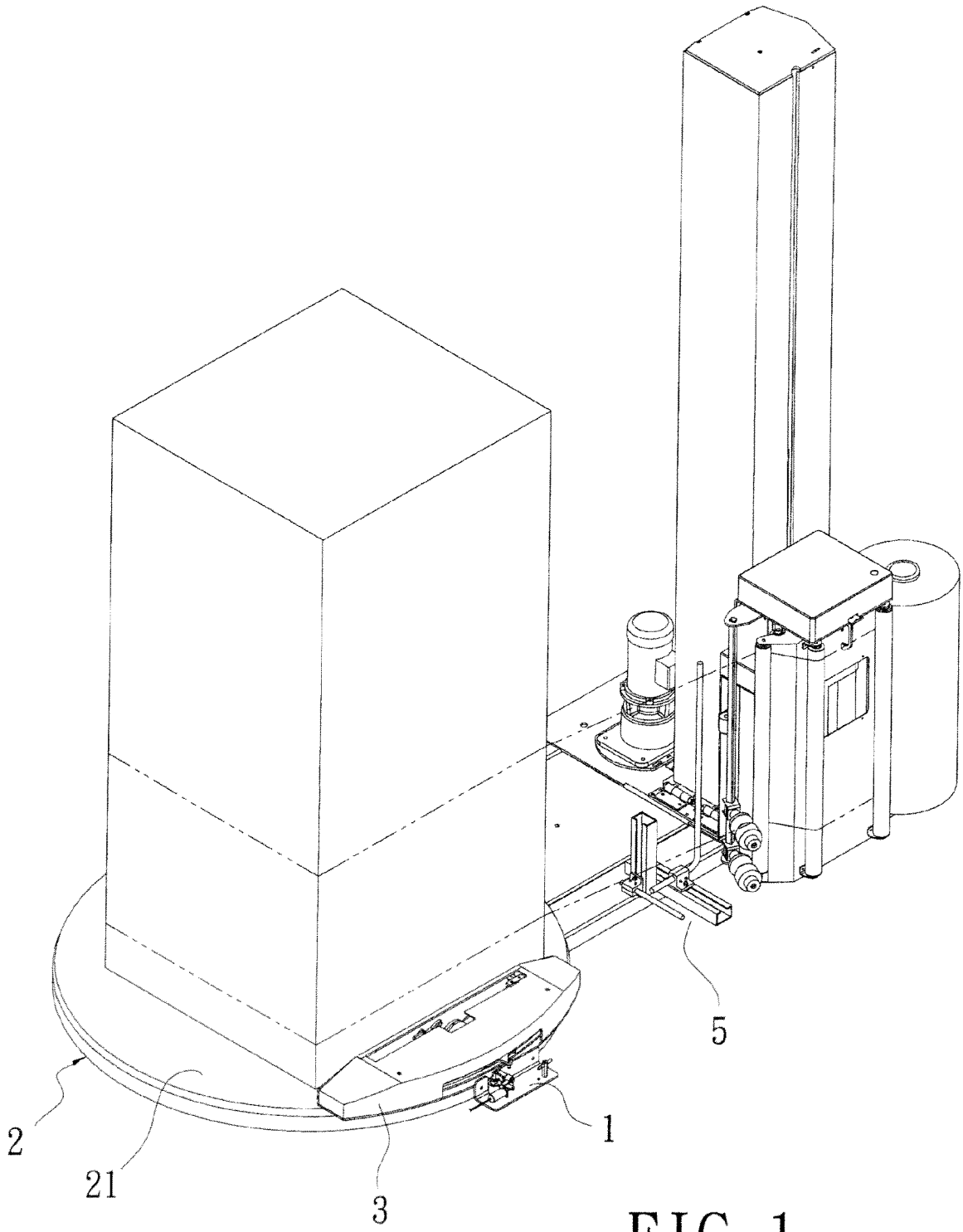
FIG. 1 is a perspective view of a film wrapping machine according to the present invention.
Figure 2:
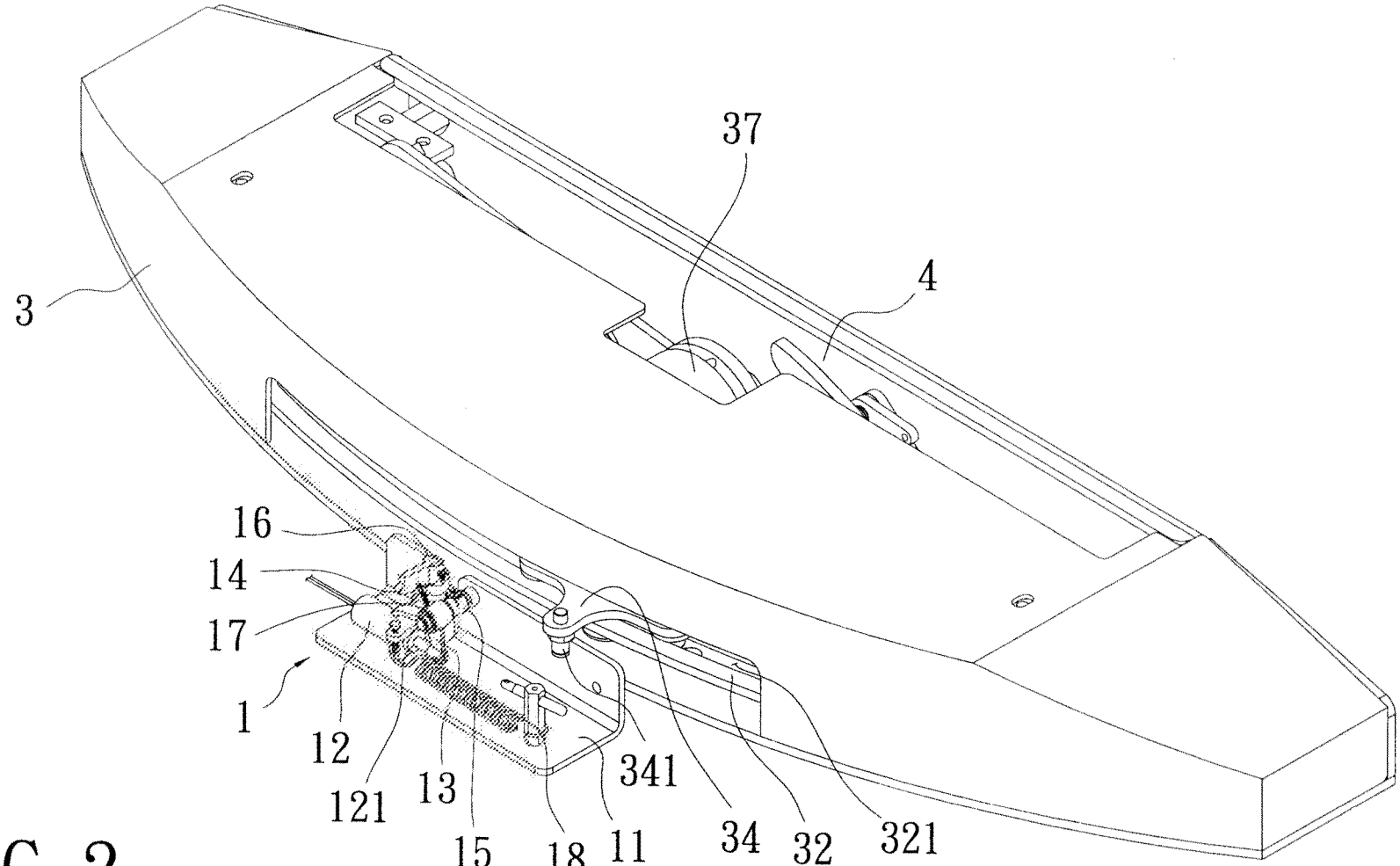
FIG. 2 is a perspective view of an embodiment of a film clamping and cutting device according to the present invention.

Refer to FIG. 1 and FIG. 2, a film clamping and cutting device of a film wrapping machine of the present invention includes a braking part 1, a film clamping and cutting unit 3 disposed on a rotating machinery 2.

Figure 3:
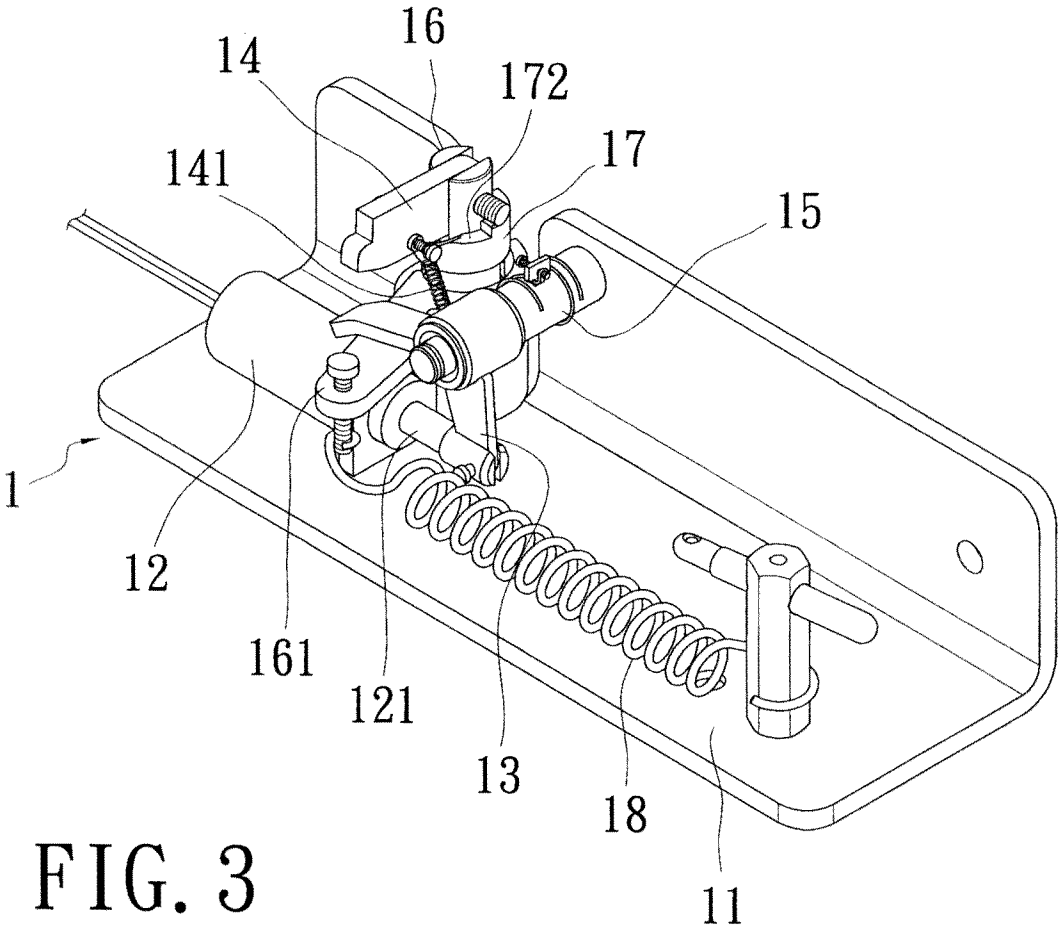
FIG. 3 is a perspective view of a braking part according to the present invention.
Figure 4:
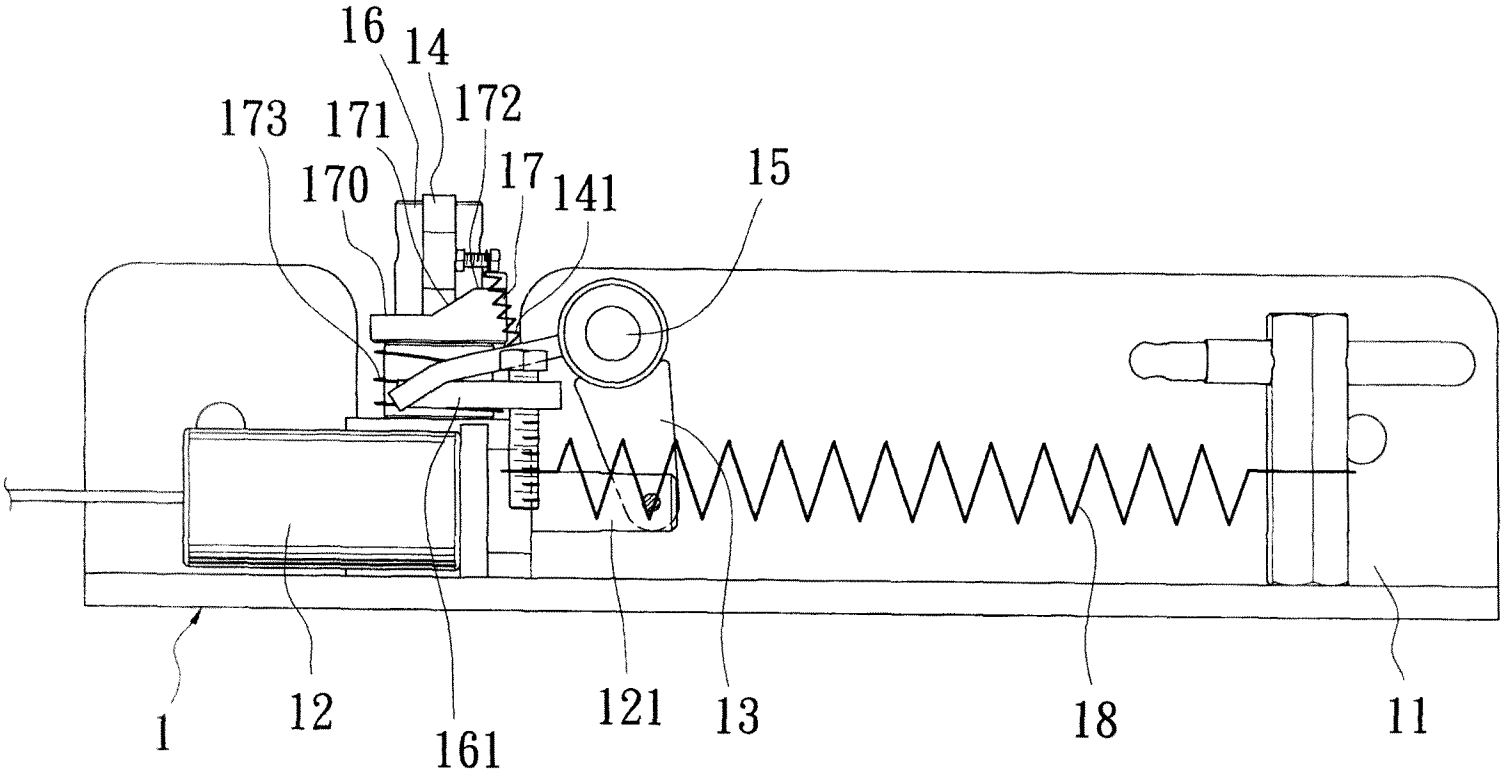
FIG. 4 is a front view of a braking part according to the present invention.

Also refer to FIG. 3 and FIG. 4, the braking part 1 is disposed on an outer side of the rotating machinery 2. The braking part 1 consists of a basal body 11, a power source 12, a support plate 13, a stop plate 14, a pivot shaft 15, a rotating rod 16, a support ring 17, and an extension spring 18. The power source 12 is mounted in the basal body 11. A force output shaft 121 of the power source 12 is connected to one end of the support plate 13 while the other end of the support plate 13 is located under the stop plate 14. The pivot shaft 15 is assembled between two ends of the support plate 13. The stop plate 14 is connected to one end of an extension spring 141 while the other end of the extension spring 141 is connected to the basal body 11. Moreover, the stop plate 14 is pivoted to the rotating rod 16. The rotating rod 16 is sleeved with the support ring 17 under the stop plate 14. A flat receiving part 170 for receiving the stop plate 14 is disposed on an upper edge of the support ring 17. Then a slope 171 extends upward from the flat receiving part 170 and the top of the slope 171 forms a stopping part 172 that is leaned against by the stop plate 14. Furthermore, a torsion spring 173 is arranged at the bottom of the support ring 17. The rotating rod 16 is connected to an extension piece 161 so as to assemble with one end of the extension spring 18 while the other end of the extension spring 8 is connected to the basal body 11.

Figure 5:
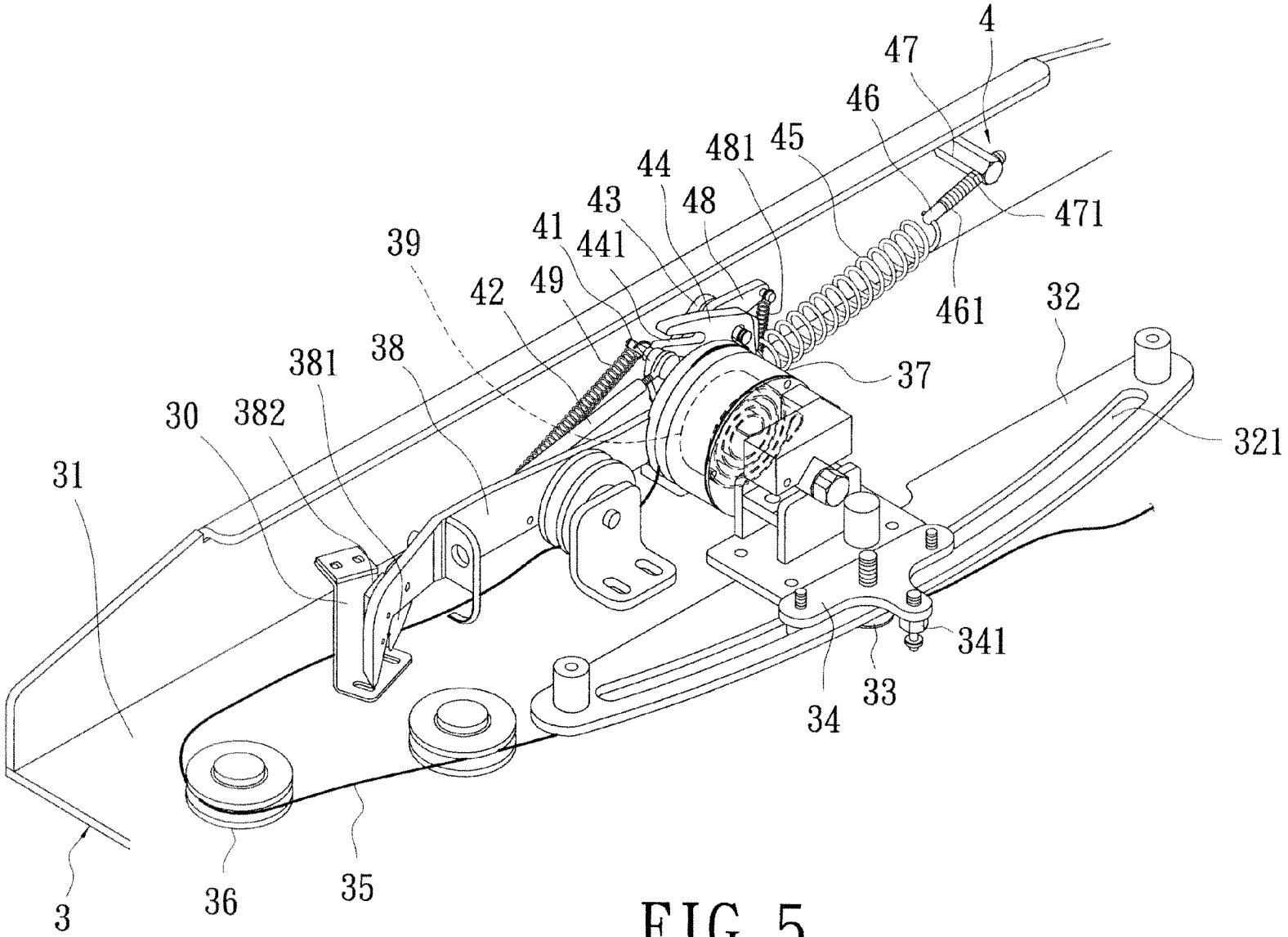
FIG. 5 is a perspective view of a film clamping and cutting unit according to the present invention.

Refer to FIG. 5, the film clamping and cutting unit 3 includes a unit main body 31 assembled on a rotating disc 21 of the rotating machinery 2 and a guiding plate 32 arranged at the unit main body 31. A curved guiding slot 321 mounted with a retaining block 33 for steel wire ropes therein is formed on the guiding plate 32 and a connecting plate 34 is disposed over the retaining block 33 for steel wire ropes. Moreover, the connecting plate 34 is arranged with a projecting block 341 and the projecting block 341 is corresponding to the stop plate 14 of the braking part 1. One end of a pull cord 35 (steel wire rope) is connected to the retaining block 33 for steel wire ropes on the bottom of the connecting plate 34 while the other end of the pull cord 35 is connected to and assembled with a vertical-wheel 37 pivoted to the unit main body 31. A plurality of guiding wheels 36 is assembled on the unit main body 31 and located between the vertical-wheel 37 and the retaining block 33 for steel wire ropes. Both the vertical-wheel 37 and the guiding wheels 36 are with grooves for the pull cord 35 (steel wire rope) to wind therearound. Furthermore, the vertical-wheel 37 is assembled with a film clamping and cutting rod 38 and a clamp 381 is disposed on a front end of the film clamping and cutting rod 38. A blade 382 is arranged at the rear side of the front end of the film clamping and cutting rod 38 and is corresponding to the clamp 381. An elastic body 39 such as a spiral spring is mounted in the vertical-wheel 37. And a blade block 30 is disposed on the unit main body 31 and located on the position that the blade 382 falls.

Figure 7:
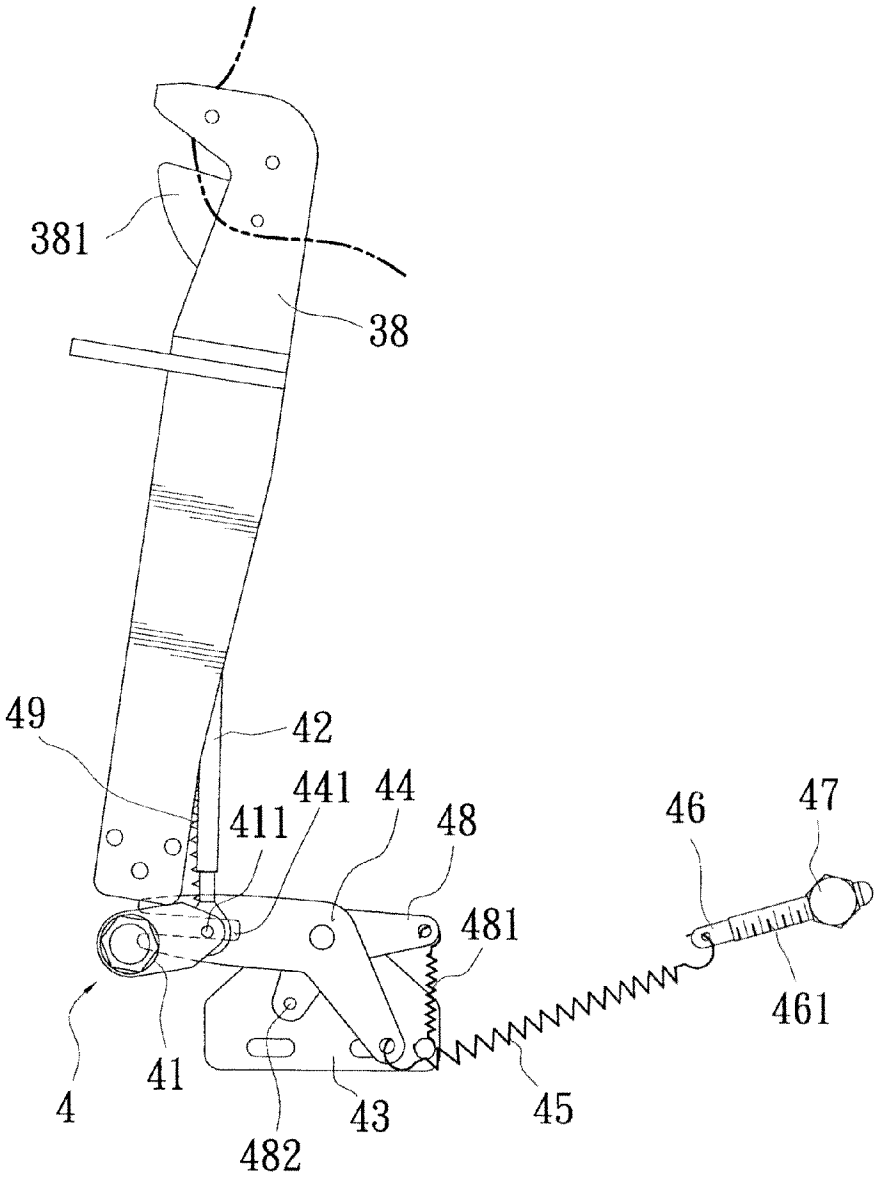
FIG. 7 is another front view of a film clamping and cutting unit according to the present invention.

Refer to FIG. 6 and FIG. 7, the film clamping and cutting device of a film wrapping machine further includes a pulling and linking set 4 having a rotating block 41 connected to an axle of the vertical-wheel 37 and a shaft 411 penetrates the rotating block 41. A connecting rod 42 connected to the clamp 381 is penetrated by the shaft 411. An elastic member 49 is arranged between the shaft 411 and the film clamping and cutting rod 38. Moreover, a fixing seat 43 fixed on the unit main body is disposed beside the vertical-wheel 37 and the fixing seat 43 is pivoted with a pulling piece 44. One end of the pulling piece 44 forms a slot 441 for mounting the shaft 411 while the other end of the pulling piece 44 is connected to one end of an elastic part 45. The other end of the elastic part 45 is connected to an adjustment rod 46.

The adjustment rod is disposed with at least one threaded portion 461 so as to be threaded with a threaded hole 471 of an adjustment base 47 connected to the unit main body 31. Furthermore, a stop piece 48 is pivoted to the fixing seat 43 and one end of the stop piece 48 is connected to one end of an elastic body 481 while the other end of the elastic body 481 is connected to the fixing seat 43. The other end of the stop piece 48 is connected to a stopper rod 482 so as to push against the pulling piece 44.

Thereby the connecting plate 34 of the film clamping and cutting unit 3 is located by the braking part 1. Then by moment (redundant force) of the rotating machinery 2 before stopping, the unit main body 31 assembled on the rotating machinery 2 is driven to continue moving. Then by the continuing movement of the unit main body 31 and the pull cord 35 whose one end is connected to the connecting plate 34 and the other end is connected to the vertical-wheel 37 of the unit main body 31, a pulling force is generated and acting on the vertical-wheel 37 to pull and rotate the vertical-wheel 37. Thus both the film clamping and cutting rod 38 assembled with the vertical-wheel 37 and the clamp 381 fall toward the blade block 30 so as to clamp and cut off a film. Moreover, the residual film is pulled and cut by an elastic recovery force of the film clamping and cutting rod. Therefore, the automatic film clamping and cutting, and applying to products on the next pallet are carried out.

Figure 8:
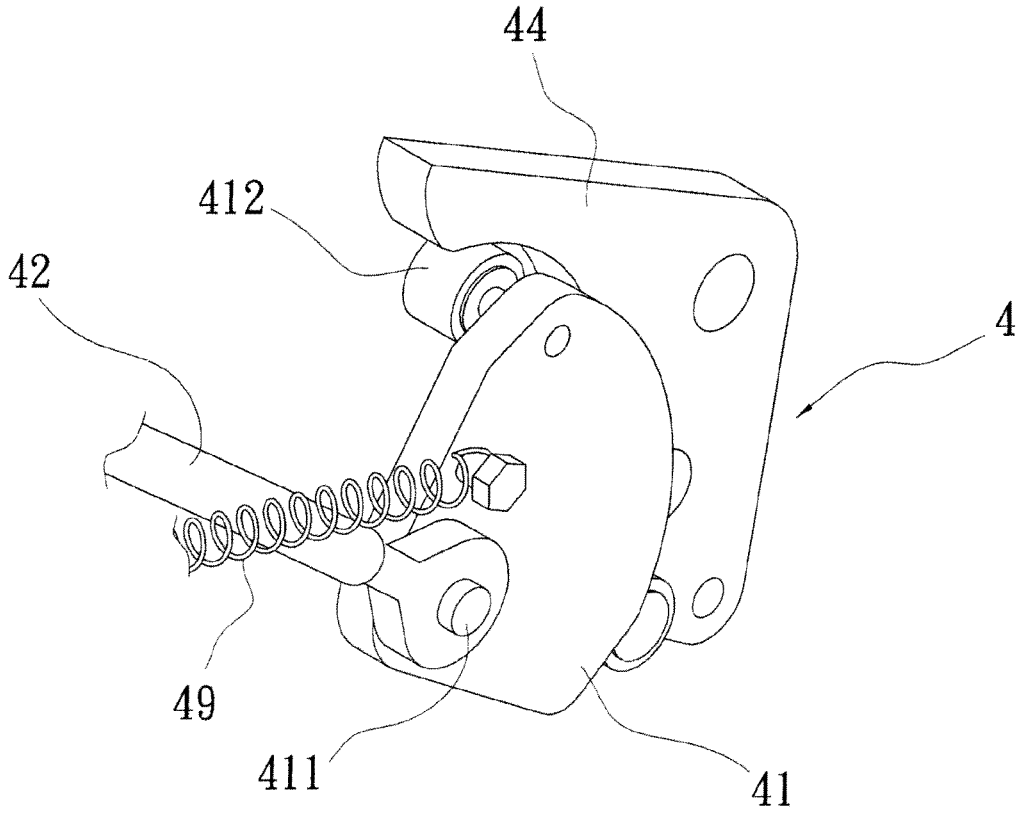
FIG. 8 is a partial enlarged view of a pulling and linking set of another embodiment according to the present invention.

Refer to FIG. 8, the pulling piece 44 of the pulling and linking set 4 is curved. One end of the rotating block 41 is connected to a sliding part 412 that is corresponding to and leaning against the bottom edge of the pulling piece 44. Due to sliding between the sliding part 412 and the pulling piece 44 in a higher pair, friction force therebetween is small and smooth movement is attained.

Figure 9:
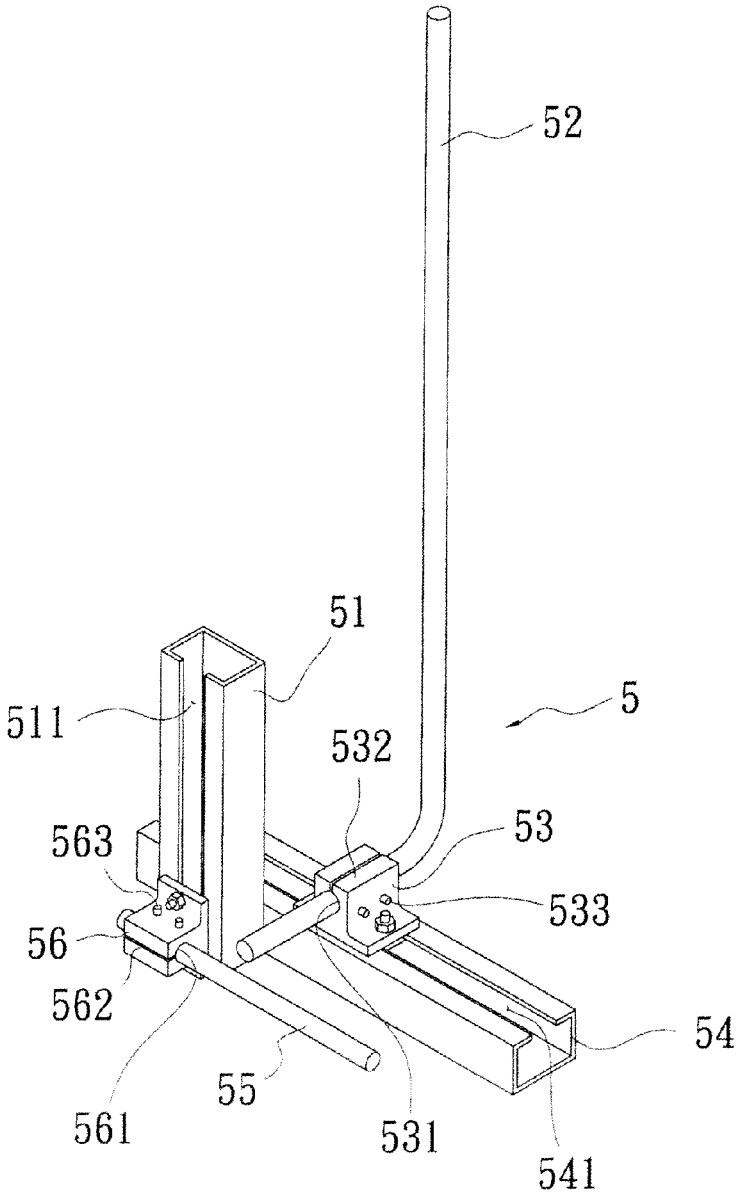
FIG. 9 is a perspective view of a film folding set according to the present invention.

Refer to FIG. 9, the present invention further includes a film folding set 5. The film folding set 5 includes a fixing rod 51, a film receiving rod 52, a base 53, a sliding seat 54, a film folding rod 55 and another base 56. The film receiving rod 52 is disposed vertically beside the fixing rod 51 and the bottom of the film receiving rod 52 penetrates a pivotal hole 531 of the base 53 and a cut groove 532 is formed on the top and bottom of the pivotal hole 531. Moreover, at least one threaded rod 533 is threaded through the cut groove 532 of the base 53 so as to adjust the tension of the film receiving rod 52 clamped by the pivotal hole 531. The sliding seat 54 is positioned under the base 53 and is provided with a sliding slot 541 in which the bottom of the base 53 slides. Furthermore, the film folding rod 55 is arranged horizontally at one side of the fixing rod 51 near the rotating machinery 2. The bottom of the film folding rod 55 penetrates a pivotal hole 561 of the base 56, and a cut groove 562 is formed on the top and bottom of the pivotal hole 561. Moreover, at least one threaded rod 563 is threaded through the cut groove 562 of the base 56 so as to adjust the tension of the film folding rod 55 clamped by the pivotal hole 561. A sliding slot 511 is formed on the fixing rod 51 so that the base 56 can move freely in the sliding slot 511. Thereby the bottom edge of the film is folded into a film strip with a certain thickness to improve strength of the film wrapped around products to be packaged. And the film is applied and cut off conveniently. The film is also pulled and cut by an elastic recovery force of the film clamping and cutting rod. Therefore automatic film clamping and cutting is carried out.

Figure 10:
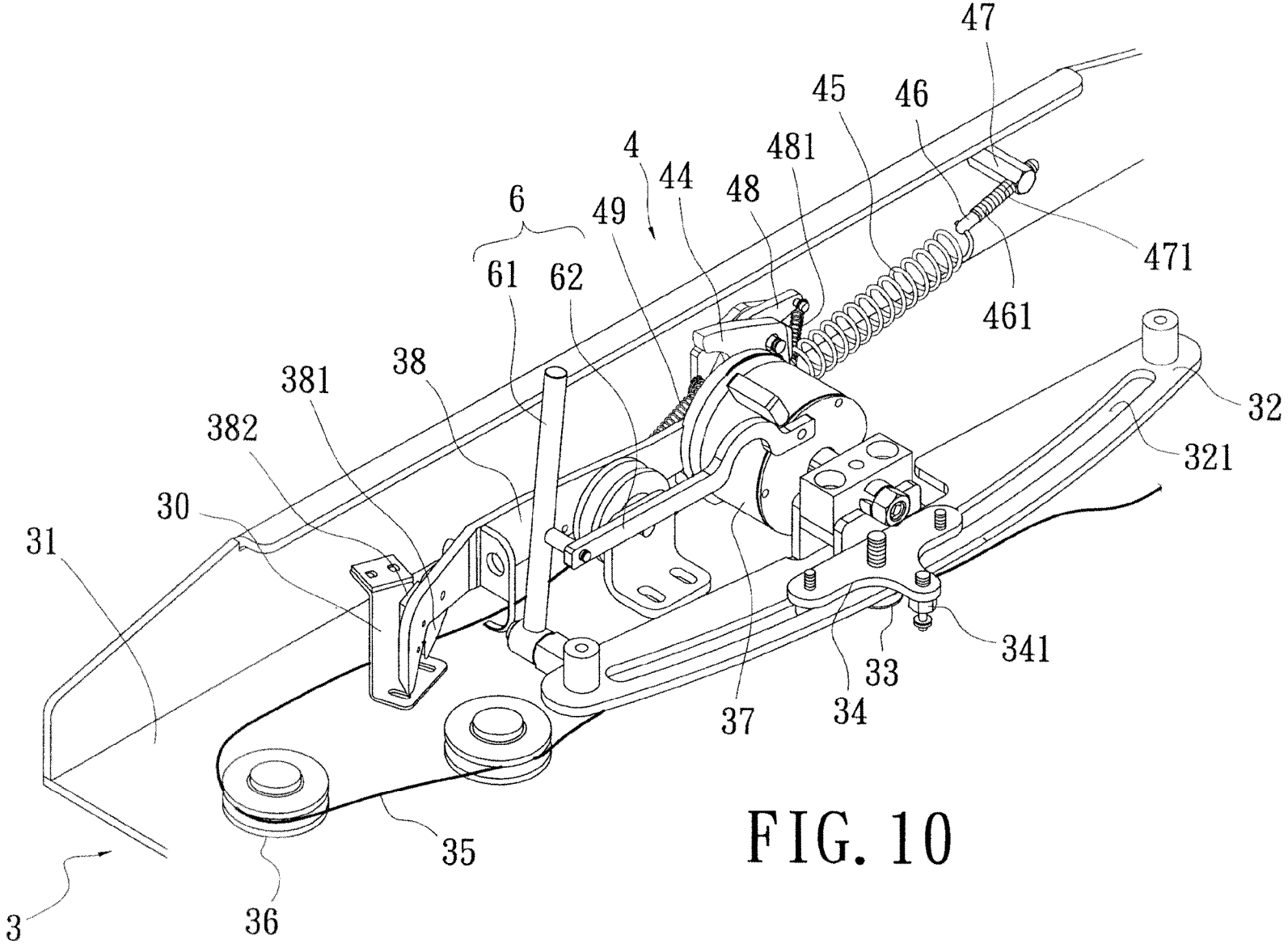
FIG. 10 is a perspective view of a film guiding member assembled on a film clamping and cutting unit according to the present invention.

Refer to FIG. 10, a film guiding member 6 is disposed in front of the film clamping and cutting rod 38. The film guiding member 6 includes a vertical membrane guiding rod 61 pivoted to the unit main body 31 and a connecting rod 62 pivoted between the membrane guiding rod 61 and the vertical-wheel 37 of the film clamping and cutting unit 3. Thereby when the vertical-wheel 37 moves and the connected film clamping and cutting rod 38 also moves toward the blade block 30, the connecting rod 62 pivoted to the vertical-wheel 37 moves toward the blade block 30 along with the rotation of the vertical-wheel 37. Thus the membrane guiding rod 61 is pushed to lean against the film so as to broaden (widen the distance between the film and products to be packaged. Therefore, the film clamping and cutting rod 38 cuts the film easily and conveniently.

Additional advantages and modifications will readily occur to those skilled in the art. Therefore, the invention, in its broader aspects is not limited to the specific details, and representative devices shown and described herein. Accordingly, various modifications may be made without departing from the spirit or scope of the general inventive concept as defined by the appended claims and their equivalents.

What is claimed is:

1. A film clamping and cutting device of a film wrapping machine comprising:

a braking part having a basal body with a power source mounted there and the power source assembled with a stop plate; and a film clamping and cutting unit including a unit main body disposed with a guiding plate and a curved guiding slot formed on the guiding plate while the curved guiding slot is mounted with a retaining block for steel wire ropes therein; a connecting plate is disposed over the retaining block for steel wire ropes and the connecting plate is arranged with a projecting block which is corresponding to the stop plate of the braking part; one end of a pull cord is connected to the bottom of the connecting plate while the other end of the pull cord is connected to and assembled with a vertical-wheel pivoted to the unit main body; a plurality of guiding wheels is assembled on the unit main body and located between the vertical-wheel and the connecting plate; the pull cord is wound around both the vertical-wheel and the guiding wheels and the vertical-wheel is assembled with a film clamping and cutting rod with a clamp on a front end thereof while a blade is arranged at a rear side of the front end of the film clamping and cutting rod and is corresponding to the clamp; an elastic body is disposed on the vertical-wheel and a blade block is disposed on the unit main body, located on the position that the blade falls.

2. The device as claimed in claim 1, wherein the film clamping and cutting device of a film wrapping machine further includes a pulling and linking set; the pulling and linking set having a rotating block connected to an axle of the vertical-wheel, and a shaft penetrating both the rotating block and a connecting rod while the connecting rod is connected to the clamp; an elastic member is arranged between the shaft and the film clamping and cutting rod; a fixing seat fixed on the unit main body is disposed beside the vertical-wheel and the fixing seat is pivoted with a pulling piece; the pulling piece having a slot on one end thereof for mounting the shaft while the other end of the pulling piece is connected to an elastic part.

3. The device as claimed in claim 2, wherein the pulling and linking set further includes an adjustment rod and an adjustment base; the adjustment rod is disposed with at least one threaded portion while the adjustment base is arranged with a threaded hole so that the adjustment base is threaded with the adjustment rod; the adjustment base is connected to and fixed on the unit main body and the adjustment rod is connected to the elastic part on the other end of the pulling piece.

4. The device as claimed in claim 2, wherein the pulling and linking set further includes a stop piece which is pivoted to the fixing seat while one end of the stop piece is connected to one end of an elastic body and the other end of the elastic body is connected to the fixing seat; the other end of the stop piece is connected to a stopper rod and the stopper rod is under the pulling piece.

5. The device as claimed in claim 1, wherein the film clamping and cutting device of a film wrapping machine further includes a pulling and linking set; the pulling and linking set having a rotating block connected to an axle of the vertical-wheel, while the other end of the rotating block is connected to a shaft and the shaft is connected to one end of a connecting rod; the other end of the connecting rod is assembled with the clamp of the film clamping and cutting unit; an elastic member is arranged between the shaft and the film clamping and cutting rod; a fixing seat fixed on the unit main body is disposed beside the vertical-wheel and the fixing seat is pivoted with a curved pulling piece; a bottom edge at one end of the pulling piece is against a sliding part connected to the rotating block while the other end of the curved pulling piece is connected to an elastic part.

6. The device as claimed in claim 5, wherein the pulling and linking set further includes an adjustment rod and an adjustment base; the adjustment rod is disposed with at least one threaded portion while the adjustment base is arranged with a threaded hole so that the adjustment base is threaded with the adjustment rod; the adjustment base is connected to and fixed on the unit main body and the adjustment rod is connected to the elastic part on the other end of the pulling piece.

7. The device as claimed in claim 5, wherein the pulling and linking set further includes a stop piece which is pivoted to the fixing seat while one end of the stop piece is connected to one end of an elastic body and the other end of the elastic body is connected to the fixing seat; the other end of the stop piece is connected to a stopper rod and the stopper rod is under the pulling piece.

8. The device as claimed in claim 1, wherein the power source of the braking part further includes a force output shaft and the force output shaft is connected to one end of a support plate while the other end of the support plate is located under the stop plate; a pivot shaft is assembled between two ends of the support plate and connected to a basal body; the stop plate is connected to one end of an extension spring while the other end of the extension spring is connected to the basal body; the stop plate is pivoted to a rotating rod; the rotating rod is sleeved with a support ring under the stop plate; a receiving part for receiving the stop plate is disposed on an upper edge of the support ring and a stopping part is formed by a slope of the receiving part extending upwards from the receiving part, wherein the stop plate is slid upwardly along the slope to be positioned against the stopping part; a torsion spring is arranged at the bottom of the support ring and the rotating rod is connected to an extension piece so as to assemble with one end of the extension spring while the other end of the extension spring is connected to the basal body.

9. The device as claimed in claim 1, wherein the film clamping and cutting device of the film wrapping machine further includes a film guiding member disposed in front of the film clamping and cutting rod of the film clamping and cutting unit; the film guiding member includes a membrane guiding rod pivoted to the unit main body and a connecting rod that is pivoted between the membrane guiding rod and the vertical-wheel of the film clamping and cutting unit.

10. The device as claimed in claim 1, wherein the film clamping and cutting device of the film wrapping machine further includes a film folding set having a fixing rod, a film receiving rod disposed vertically beside the fixing rod, a film folding rod arranged horizontally at one side of the fixing rod, and a base with a pivotal hole for receiving the film receiving rod and the film receiving rod penetrating the pivotal hole; a cut groove is formed on a top and a bottom of the pivotal hole; at least one threaded rod is threaded through the cut groove of the base; a sliding seat is positioned under the base and is provided with a sliding slot in which the bottom of the base slides.

* * * * *